US007832504B2

(12) United States Patent
Wolfer et al.

(10) Patent No.: US 7,832,504 B2
(45) Date of Patent: Nov. 16, 2010

(54) EXHAUST VALVE AND BIT ASSEMBLY FOR DOWN-HOLE PERCUSSIVE DRILLS

(75) Inventors: Dale R. Wolfer, Salem, VA (US); Timothy J. Plunkett, Roanoke, VA (US); Leland H. Lyon, Roanoke, VA (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 317 days.

(21) Appl. No.: 11/919,468

(22) PCT Filed: Apr. 27, 2006

(86) PCT No.: PCT/US2006/016126

§ 371 (c)(1),
(2), (4) Date: Oct. 29, 2007

(87) PCT Pub. No.: WO2006/116646

PCT Pub. Date: Nov. 2, 2006

(65) Prior Publication Data

US 2009/0308661 A1 Dec. 17, 2009

Related U.S. Application Data

(60) Provisional application No. 60/675,215, filed on Apr. 27, 2005.

(51) Int. Cl.
*E21B 4/14* (2006.01)
*B23Q 5/00* (2006.01)

(52) U.S. Cl. ..... 175/296; 175/414; 175/420.2; 173/13

(58) Field of Classification Search ..... 175/296, 175/414, 420.2; 173/17, 16, 13, 80, 79
See application file for complete search history.

(56) References Cited

U.S. PATENT DOCUMENTS 4,084,647 A 4/1978 Lister (Continued)

FOREIGN PATENT DOCUMENTS

GB 1474501 5/1977

OTHER PUBLICATIONS

Extended European Search Report (EESR) dated Dec. 23, 2009 for European Patent Application No. 06751696.3.

(Continued)

*Primary Examiner*—David J Bagnell
*Assistant Examiner*—Yong-Suk Ro
(74) *Attorney, Agent, or Firm*—Michael Best & Friedrich LLP

(57) ABSTRACT

A bit assembly is for a percussive drill that includes a casing with an interior chamber and includes a bit connectable with the casing and having a longitudinal bore and an axis through the bore. The bore has a retainer portion with one or more generally conical inner surfaces extending circumferentially about and facing generally toward the axis. A generally cylindrical valve has a longitudinal passage with an inlet fluidly connectable with the casing chamber and an outlet fluidly connectable with the bit central bore and an axis through the passage. An engagement portion with at least one generally conical outer surface extends circumferentially about and faces generally away from the valve axis. The valve engagement portion is disposable within the bit bore retainer portion such that the valve conical outer surface is disposed within and against the bit conical inner surface to retain the valve coupled with the bit.

30 Claims, 8 Drawing Sheets

U.S. PATENT DOCUMENTS

| | | | | |
|---|---|---|---|---|
| 4,146,097 | A | | 3/1979 | Curington |
| 4,821,812 | A | | 4/1989 | Ditzig |
| 5,085,284 | A | | 2/1992 | Fu |
| 5,139,095 | A | | 8/1992 | Lyon et al. |
| 5,143,162 | A | | 9/1992 | Lyon et al. |
| 5,240,083 | A | | 8/1993 | Lyon |
| 5,301,761 | A | | 4/1994 | Fu et al. |
| 5,325,926 | A | | 7/1994 | Lay et al. |
| 5,390,749 | A | | 2/1995 | Lyon |
| 5,562,170 | A | | 10/1996 | Wolfer et al. |
| 5,566,771 | A | | 10/1996 | Wolfer et al. |
| 5,647,447 | A | | 7/1997 | Jones |
| 5,682,957 | A | | 11/1997 | Lyon |
| 5,699,867 | A | | 12/1997 | Jones |
| 5,711,205 | A | * | 1/1998 | Wolfer et al. ..... 92/155 |
| 5,735,358 | A | | 4/1998 | Lyon |
| 5,794,516 | A | | 8/1998 | Wolfer et al. |
| 6,135,216 | A | | 10/2000 | Lyon et al. |
| 6,170,581 | B1 | | 1/2001 | Lay |
| 6,237,704 | B1 | | 5/2001 | Lay |
| 6,799,641 | B1 | | 10/2004 | Lyon et al. |
| 7,159,676 | B2 | | 1/2007 | Lyon |
| 7,467,675 | B2 | | 12/2008 | Lay |
| 7,624,822 | B2 | * | 12/2009 | Olsson et al. ..... 175/293 |

OTHER PUBLICATIONS

PCT/US06/16126 International Search Report dated Sep. 29, 2006 (1 page).

* cited by examiner

EXHAUST VALVE AND BIT ASSEMBLY FOR DOWN-HOLE PERCUSSIVE DRILLS

RELATED APPLICATIONS

This application is a 371 of PCT/US2006/016126, filed on Apr. 27, 2006, which claims the benefit of U.S. Provisional Patent Application 60/675,215, filed on Apr. 27, 2005.

The present invention relates to down-hole drill assemblies, and more specifically to bit assemblies for such down-hole drills.

Down-hole percussive drills generally include a casing connected with a source of pressurized working fluid (e.g., compressed air), a piston movably disposed within the casing and reciprocally driven by the fluid, and a bit connected with the casing and including cutting elements on an outer face. In use, the working fluid is appropriately directed to reciprocate the piston between an impact position, at which the piston strikes against the bit inner end, and an initial or drive position, from which the piston is driven to achieve an amount of momentum prior to impact with the bit. The piston is displaced toward the drive position by fluid channeled into a return chamber defined generally between the piston and bit. However, after the piston starts moving toward the drive position (i.e., away from the bit), fluid within the return chamber must be exhausted, preferably through a longitudinal bore of the bit, to prevent such fluid from slowing the piston when it moves back toward impact with the bit.

To prevent premature exhaustion of the return chamber, percussive drills are often provided with a device known as an exhaust tube or "foot" valve that extends into the return chamber from the bit contact end. The valve has a portion that is insertable into a passage of the piston to prevent evacuation of the chamber until the piston reaches a certain distance from the bit. Such a valve is inserted into the bit bore and is typically maintained in the bore by one or more annular shoulders projecting from the valve, which become disposed in annular grooves extending radially outwardly from the bore into the bit body. Although such as design for retaining the valve within the bit bore is generally effective, stress tends to concentrate at the points of contact between the valve shoulder and bit grooves, which may cause early failure of the valve.

SUMMARY OF THE INVENTION

In one aspect, the present invention is a bit assembly for a percussive drill, the drill including a casing with an interior chamber. The bit assembly comprises a bit connectable with the casing and having a longitudinal bore and an axis extending centrally through the bore. The bore has a retainer portion with at least one generally conical inner surfaces extending circumferentially about and facing generally toward the axis. Further, a generally cylindrical valve has a longitudinal passage, the passage having an inlet fluidly connectable with the return chamber and an outlet fluidly connectable with the bit central bore, an axis extending centrally through the passage, and an engagement portion. The engagement portion has at least one generally conical outer surfaces extending circumferentially about and facing generally away from the valve axis. Furthermore, the valve engagement portion is disposable within the bit bore retainer portion such that the valve conical outer surface is disposed within and against the bit conical inner surface so as to retain the valve coupled with the bit.

In another aspect, the present invention is a percussive drill assembly comprising a casing with an interior chamber and a longitudinal axis a piston movably disposed within the casing chamber. The piston is displaceable generally along the axis and has a central longitudinal axis. A bit is connected with the casing and has a longitudinal bore and an axis extending centrally through the bore. The bore has a retainer portion with one or more generally conical inner surfaces extending circumferentially about and facing generally toward the axis, the conical surfaces being spaced apart axially when the bit has at least two surfaces. Further, a generally cylindrical valve has a longitudinal passage, the passage having an inlet fluidly connected with the return chamber and an outlet fluidly connected with the bit central bore, an axis extending centrally through the passage, and an engagement portion. The valve engagement portion has one or more generally conical outer surfaces extending circumferentially about and facing generally away from the valve axis, the conical surfaces being spaced apart axially when the valve has at least two surfaces. Furthermore, the valve engagement portion is disposed within the bit bore retainer portion to thereby couple the valve with the bit, each valve conical outer surface being disposed against a separate bit conical inner surface.

In a further aspect, the present invention is again a bit assembly for a percussive drill, the drill including a casing with an interior chamber. The bit assembly comprises a bit connectable with the casing and having a longitudinal bore and an axis extending centrally through the bore. The bore has a retainer portion with at least one generally conical inner surface extending circumferentially about and facing generally toward the axis, the inner conical surface extending along a substantial portion of the bore. A generally cylindrical valve has a body with a longitudinal passage, the passage having an inlet fluidly connectable with the casing chamber and an outlet fluidly connectable with the bit central bore. An axis extends centrally through the passage, the body having a length along the axis, and an engagement portion with at least one generally conical outer surface extending circumferentially about and facing generally away from the valve axis, the at least one outer conical surface extending along a substantial portion of the body length. The valve engagement portion is disposable within the bit bore retainer portion such that the valve conical outer surface is disposed at least partially within the bit conical inner surface to retain the valve coupled with the bit, at least a substantial portion of the valve outer surface being engageable with the bit inner surface so that a generally uniform contact pressure is generated between the inner and outer conical surfaces.

In a further aspect, the present invention is an exhaust valve for a percussive drill, the drill including a casing with an interior chamber and a bit connectable with the casing. The bit has inner and outer ends and a longitudinal bore extending between the two ends and having an inner circumferential surface. The exhaust valve comprises a generally cylindrical body with first and second ends and a longitudinal passage extending between the two ends, the passage having an inlet at the first end fluidly connectable with the casing chamber and an outlet at the second end fluidly connectable with the bit central bore. The valve body includes a generally cylindrical regulator portion disposable within the casing chamber and a generally conical engagement portion spaced axially from the regulator portion and at least partially disposable within the inner end of the bit bore. The engagement portion has at least one generally conical outer surface frictionally engageable with the bit bore inner surface to retain the valve coupled with the bit. Further, the at least one conical surface has a first circumferential edge located generally proximal to the regulator portion, a second circumferential edge located generally proximal to the body second end, and an outside diameter that varies generally linearly between a first value at the surface first edge and a second value at the surface second edge, the diameter second value being greater than the diameter first value.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
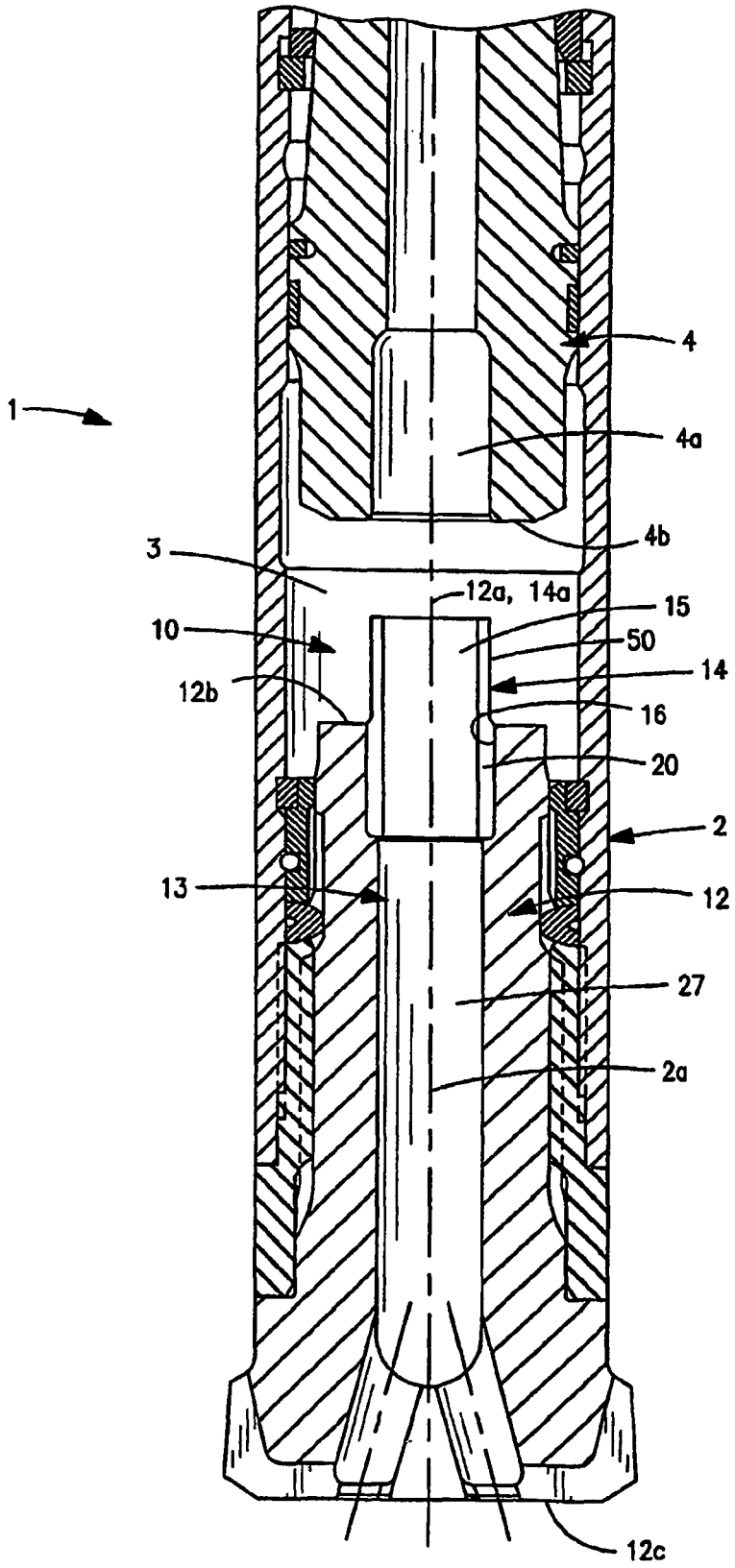
FIG. 1 is a broken-away, cross-sectional view of a drill having a bit assembly in accordance with the present invention.

Certain terminology is used in the following description for convenience only and is not limiting. The words "lower", "upper", "upward", "down" and "downward" designate directions in the drawings to which reference is made. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words of similar import.

Referring now to the drawings in detail, wherein like numbers are used to indicate like elements throughout, there is shown in FIGS. 1-8 a bit assembly 10 for a percussive drill 1. The drill 1 includes a casing 2, the casing 2 having an interior chamber 3 and a longitudinal axis 2*a*, and a piston 4 movably disposed within the casing chamber 3 so as to be displaceable generally along the axis 2*a*, the piston 4 having a central longitudinal passage 4*a*. The bit assembly 10 basically comprises a bit 12 connectable with the casing 2 and a generally cylindrical or tubular exhaust valve 14 coupleable with the bit 12. The bit 12 has a longitudinal bore 13, an axis 12*a* extending centrally through the bore 13, and opposing inner and outer axial ends 12*b*, 12*c*, the inner or upper end 12*b* being disposed within the casing 2 (and contactable by the piston 4) and the outer or lower end 12*c* being disposed generally externally of the casing 2 when the bit 12 is connected with the casing 2. The bit bore 13 has a retainer portion 16 with at least one generally conical inner surface 18 extending circumferentially about and facing generally toward the axis 12*a* and a flow portion 27 extending between the engagement portion 16 and the bit outer end 12*c*. In a first construction shown in FIGS. 1-5, the bit 12 has a single conical inner surface 18 extending along a substantial part (i.e., substantially the entire extent) of the retainer portion 16. Alternatively, in a second construction depicted in FIGS. 6-8, the bit retainer portion 16 includes a plurality of conical surface sections 19 (e.g., three sections 19A, 19B, 19C, as shown) spaced apart generally along the bit axis 12*a*, and one or more generally concave surfaces 21 (FIG. 8) extending between each pair of adjacent conical surface sections 19, as described in further detail below.

Further, the exhaust valve 14 has a longitudinal axis 14*a*, opposing ends 14*b*, 14*c* spaced apart along the axis 14*a*, and a longitudinal passage 15. The valve passage 15 has a first port or inlet 15*a* extending through the valve first or upper end 14*b* and fluidly connectable with the casing chamber 3 and a second port or outlet 15*b* extending through the valve second or lower end 14*c* and fluidly connectable with the bit central bore 13, the axis 14*a* extending centrally through the passage 15. Preferably, the valve 14 includes a generally cylindrical body 17 with first end second ends 17*a*, 17*b* and a generally circular bore 17*c* extending between the two ends 17*a*, 17*b* and providing the passage 15, but may alternatively be constructed having any other appropriate shape/structure that is capable of functioning as generally described herein.

Furthermore, the valve 14 has an engagement portion 20 with at least one generally conical outer surface 22 extending circumferentially about and facing generally away from the valve axis 14*a*. In a first construction shown in FIGS. 1-5, the valve 14 has a single conical outer surface 22 extending along a substantial part or axial extent of the engagement portion 20. More specifically, the valve body 17 has a length L along the axis 14*a* and the outer conical surface 22 (and thus also the engagement portion 20) preferably extends along a substantial portion of the body length L (e.g., about one half of the length L), such that a relatively large contact area is provided by the valve engagement portion 20. In a second construction depicted in FIGS. 6-8, the valve engagement portion 20 includes a plurality of conical surface sections 23 (e.g., three sections 23A, 23B, 23C, as shown) spaced apart generally along the valve axis 14*a*, and one or more generally concave surfaces 25 extending between each pair of adjacent conical surface sections 23, as described in further detail below.

Figure 3:
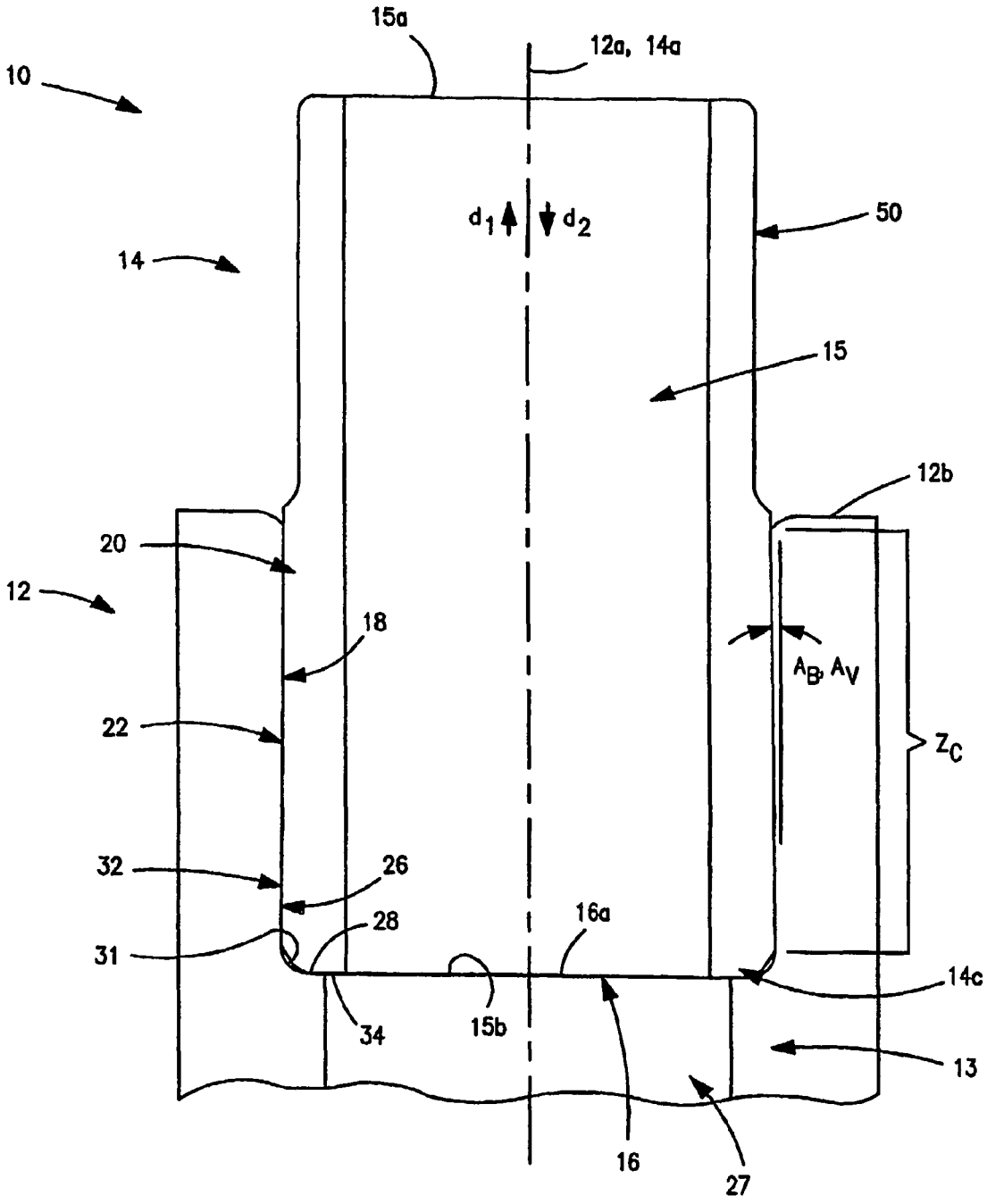
FIG. 3 is another enlarged, broken-away cross-sectional view of a bit and valve of FIG. 2, shown with the valve coupled with the bit.
Figure 4:
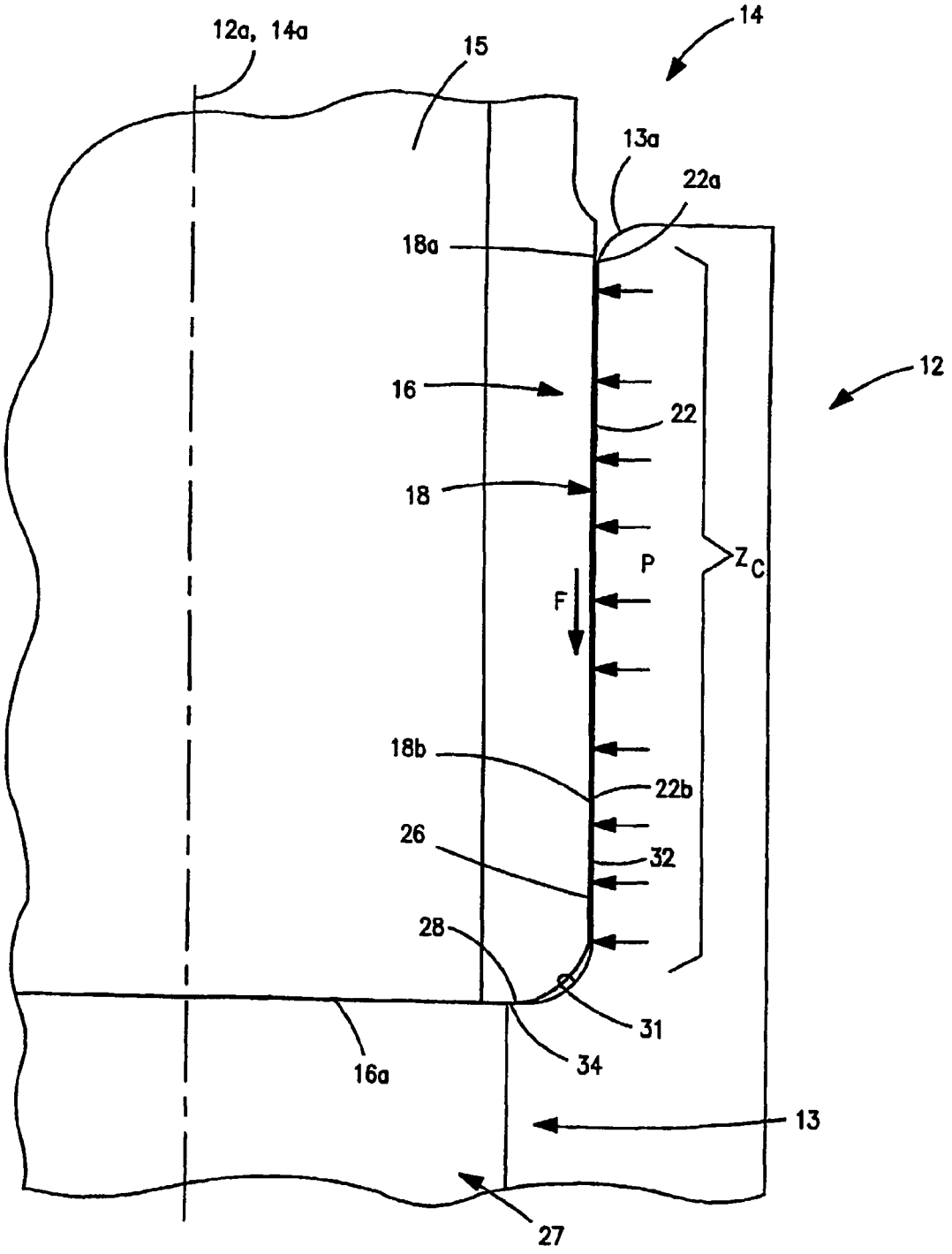
FIG. 4 is a greatly enlarged, broken-away view of a portion of FIG. 3.
Figure 6:
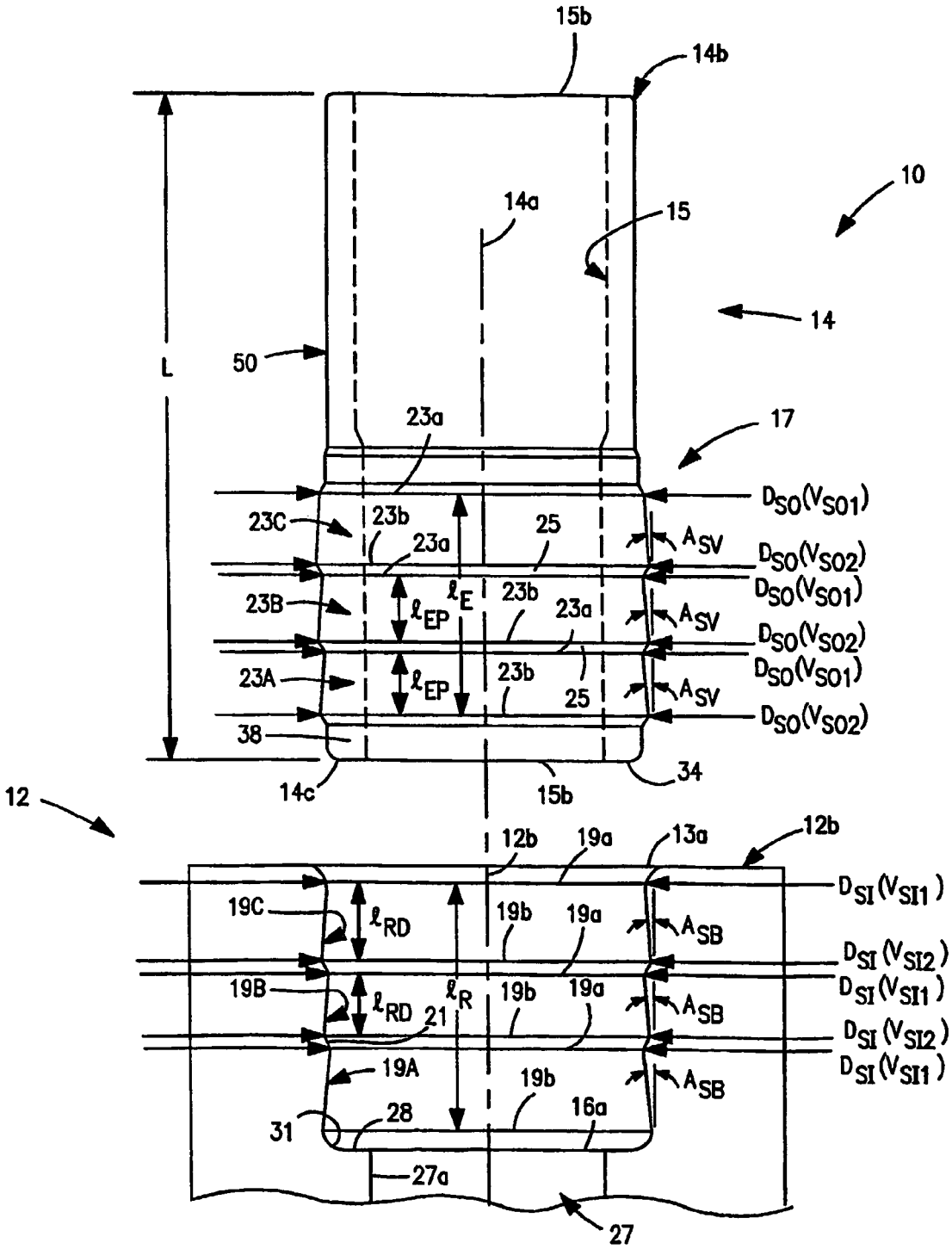
FIG. 6 is an enlarged, broken-away cross-sectional view of a second construction of the bit assembly, shown with the bit and valve spaced apart prior to coupling thereof.

Referring to FIGS. 1, 3 and 4, in the first construction, the valve engagement portion 20 is disposable within the bit bore retainer portion 16 to couple the valve 14 with the bit 12, such that the valve conical outer surface 22 is disposed substantially entirely against the bit conical inner surface 18. In other words, at least a substantial portion of the valve outer conical surface 22 contacts or engages with the valve inner conical surface 18 when the valve 14 is engaged with the bit 12. With the second bit assembly construction, each valve conical outer surface section 23A, 23B, 23C, etc. is disposed substantially entirely against a separate one of the bit conical inner surface sections 19A, 19B, 19C, etc., respectively, as shown in FIG. 6. Preferably, the valve conical outer surface 22 or surface sections 23 are each frictionally engageable with the bit conical inner surface 18 or a corresponding surface section 19 so as to thereby couple the valve 14 with the bit 12. Most preferably, the valve conical surface 22 or surface sections 23 are each engageable with the bit conical surface 18/surface section 19 such that a normal or "contact" pressure P between the two conical surfaces 18, 22 or surface sections 19, 23 is at least generally and preferably substantially uniform at all points within a contact zone $Z_C$ extending generally along the bit axis 14*a* (see FIG. 4). In other words, the frictional force F coupling the valve 14 and the bit 12 is generally equal at all points of contact between the valve conical outer surface 22, or surface sections 23, and the bore conical inner surface 18 or surface sections 19. Although it is preferred to maintain the two parts 12, 14 coupled together once connected, the valve 14 may be uncoupled from the bit 12 by applying a sufficient axial force to slide the valve engagement portion 20 out of the bit retainer portion 16.

Figure 2:
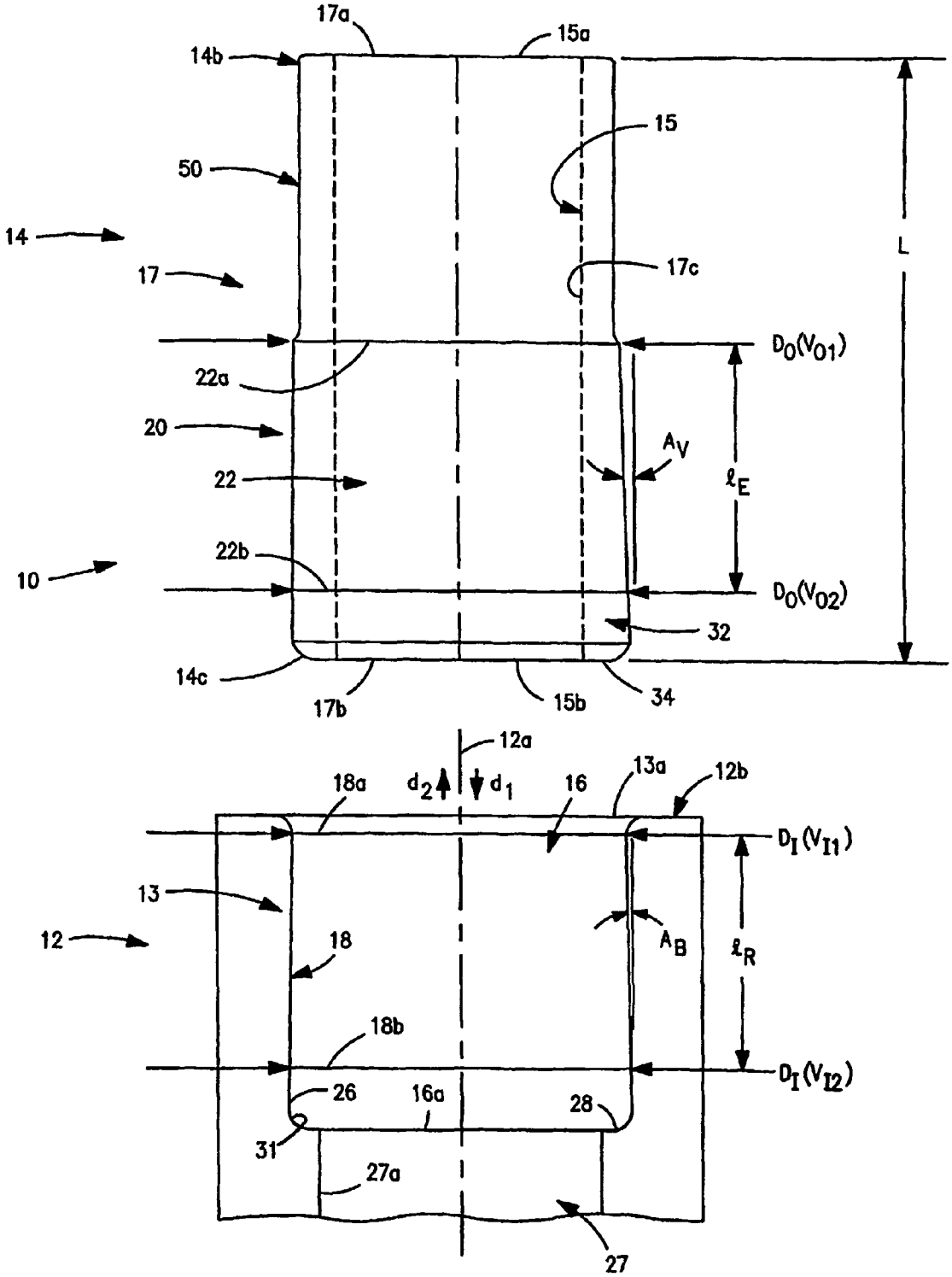
FIG. 2 is an enlarged, broken-away cross-sectional view of a first construction of the bit assembly, shown with the bit and valve spaced apart prior to coupling thereof.

Referring to FIGS. 2-5, with the first construction of the bit assembly 10, the bore conical inner surface 18 has axially spaced apart circumferential edges 18*a*, 18*b*, the first edge 18*a* being located generally proximal to the bit inner end 12*b* and the second edge 18*b* being located generally between the bit inner and outer ends 12*a*, 12*b*, and an inside diameter $D_I$. The bore conical surface inside diameter $D_I$ varies generally linearly between a first value $v_{I1}$ at the surface first edge 12*a* and a second value $v_{I2}$ at the surface second edge 18*b*, the second value $v_{I2}$ being greater than the first value $v_{I2}$. In other words, the inside diameter $D_I$ of the bore inner conical surface 18 tapers from the second edge 18*b* to the first edge 18*a* through a generally constant taper angle $A_B$, as indicated in FIGS. 2 and 3. In a similar manner, the valve conical outer surface 22 has axially-spaced apart first and second circumferential edges 22*a*, 22*b*, the valve surface first edge 22*a* being disposed proximal to the bit surface first edge 18*a* and the valve surface second edge 22*b* being disposed proximal to the bit surface second edge 18*b* when the valve 14 is coupled with the bit 12, and an outside diameter $D_O$. The valve outside diameter $D_O$ varies generally linearly between a first value $v_{O1}$ at the valve surface first edge 22*a* and a second value $v_{O2}$ at the valve surface second edge 22*b*, the second value $v_{O2}$ being greater than the first value $v_{O1}$. Thus, the outside diameter $D_O$ of the valve outer conical surface 22 tapers from the second edge 22*b* to the first edge 22*a* through a generally constant taper angle $A_V$ (see FIGS. 2 and 3). The valve taper angle $A_V$ is substantially equal to the bit taper angle $A_B$; preferably, each one of the bit and valve taper angles $A_B$, $A_V$ has a value between about 0.5° and about 3.0°.

Furthermore, when the valve 14 is separate from or "non-engaged" with the bit 12, the first value $v_{O1}$ of the valve outside diameter $D_O$ is greater than the first value $v_{I1}$ of the bit inside diameter $D_I$ and the second value $v_{O1}$ of the valve outside diameter $D_O$ is greater than the second value $v_{O1}$ of the bit inside diameter $D_I$. In other words, when the two components 12, 14 are uncoupled, the valve outer surface 22 is spaced outwardly from the valve axis 14*a* by a greater radial distance than the bit inner surface 18 is spaced from the bit axis 12*a*. As such, when the valve engagement portion 20 is inserted into the bore retainer portion 16, the valve 14 engages the bit 12 with an interference fit. Specifically, the valve engagement portion 20 must be press-fit into the bore retainer section 16, which, due to the structure described above, generates the substantially uniform contact pressure P between the mating surfaces 18, 22, and thus the frictional forces that maintain the valve 14 coupled with the bit 12.

Figure 7:
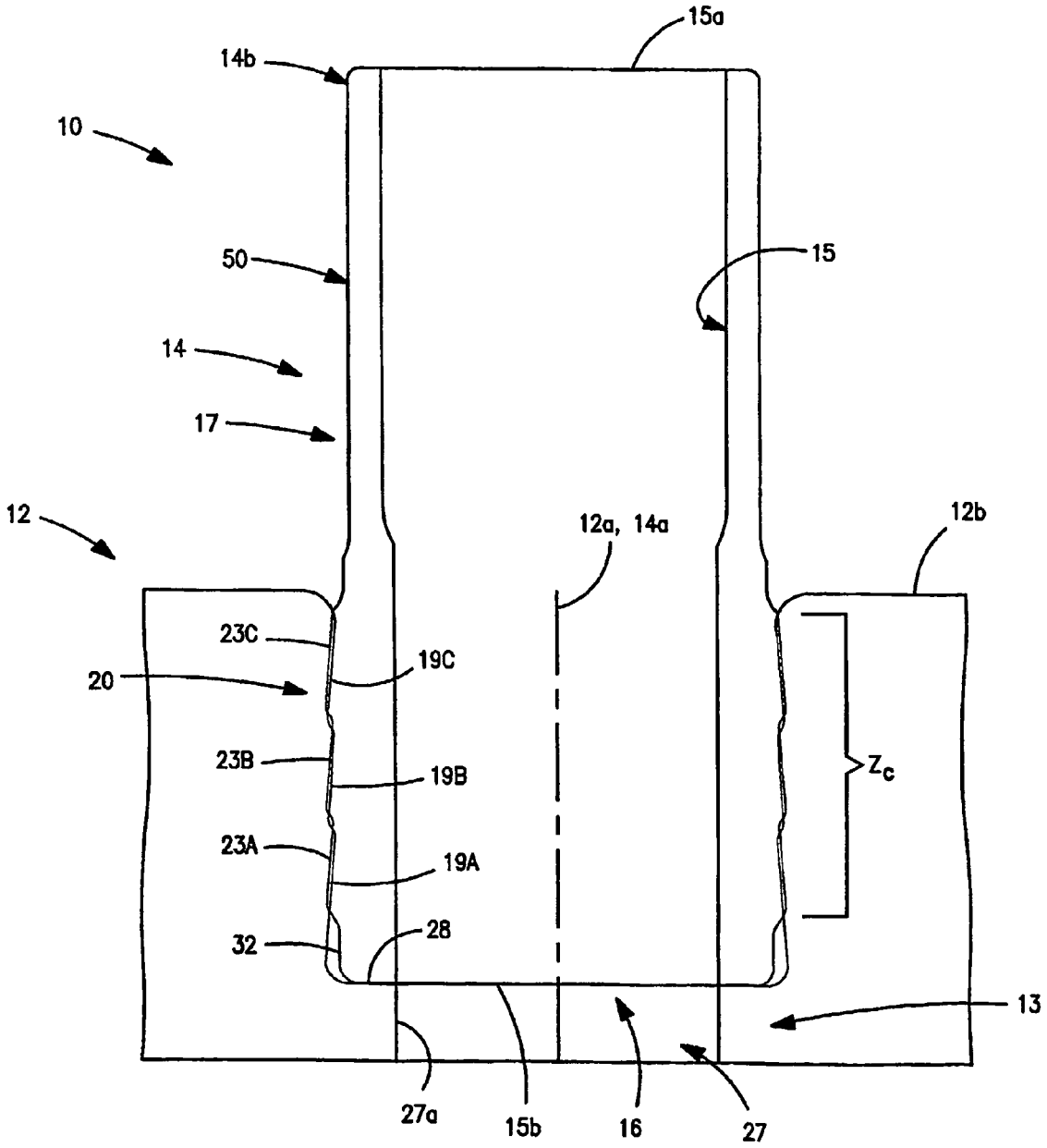
FIG. 7 is another enlarged, broken-away cross-sectional view of a bit and valve of FIG. 6, shown with the valve coupled with the bit.
Figure 8:
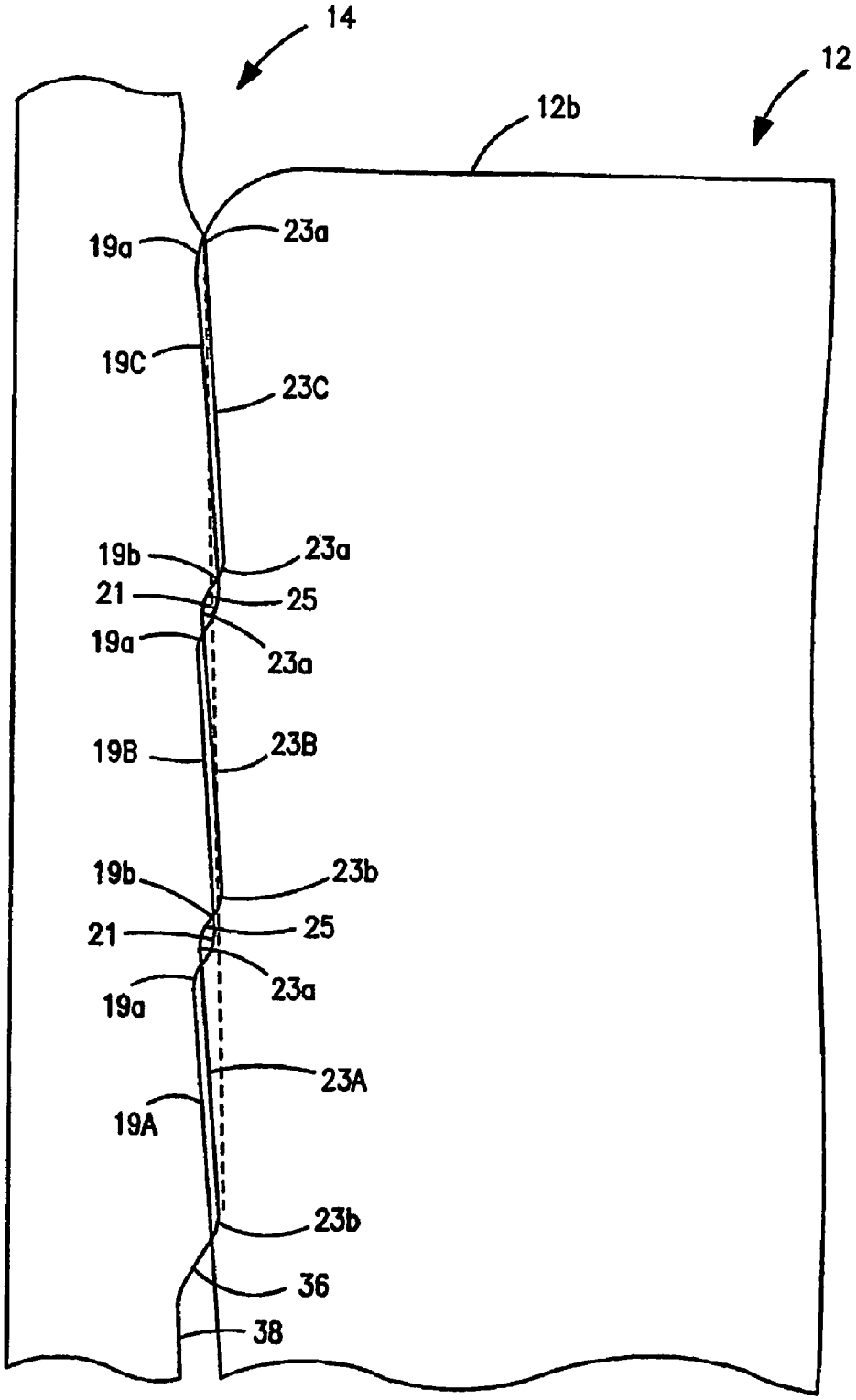
FIG. 8 is a greatly enlarged, broken away view of a portion of FIG. 7.

Referring instead to FIGS. 6-8, in a manner similar to the first construction, each bore conical inner surface section 19 of the second bit construction has axially spaced apart circumferential edges 19*a*, 19*b* and an inside diameter $D_{SI}$. Each first edge 19*a* being located generally more proximal to the bit inner end 12*b* and each second edge 19*b* being located generally more distal from the bit inner end 12*b*, the one or more concave surfaces 21 extending between the second edge 19*b* of one surface section (e.g., 19A) and the first edge 19*b* of an adjacent surface section (e.g., 19B). Each bore conical surface section inside diameter $D_{SI}$ varies generally linearly between a first value $v_{SI1}$ at the surface first edge 19*a* and a second value $v_{SI2}$ at the surface second edge 19*b*, the second value $v_{I2}$ being greater than the first value $v_{SI2}$, such that each inside diameter $D_{SI}$ of the inner surface sections 19A, 19B, 19C tapers from the second edge 19*b* to the first edge 19*a* through a generally constant taper angle $A_{SB}$, as indicated in FIG. 6. Similarly, the valve conical outer surface sections 23 of the second valve construction each have axially-spaced apart first and second circumferential edges 23*a*, 23*b* and an outside diameter $D_{SO}$, the one or more concave surfaces 25 extending between the second edge 23*b* of one surface section (e.g., 23A) and the first edge 23*b* of an adjacent surface section (e.g., 23B). Each valve surface section first edge 23*a* is disposed proximal to a corresponding bit surface section first edge 19*a*, and each valve surface second edge 23*b* is disposed proximal to the corresponding bit surface section second edge 19*b*, when the valve 14 is coupled with the bit 12. Each valve surface section outside diameter $D_{SO}$ varies generally linearly between a first value $v_{O1}$ at the valve surface first edge 23*a* and a second value $v_{SO2}$ at the valve surface second edge 23*b*, the second value $v_{O2}$ being greater than the first value $v_{SO1}$. Thus, the outside diameter $D_{SO}$ of each valve outer conical surface section 23 tapers from each second edge 23*b* to each first edge 23*a* through a generally constant taper angle $A_{SV}$, and the angles $A_{SV}$ of the multiple surface sections 23 are substantially equal (see FIG. 6). Further, each valve surface section taper angle $A_{SV}$ is substantially equal to the taper angle $A_{SB}$ of each corresponding bit surface section 19; preferably, each one of the bit and valve surface section taper angles $A_{SB}$, $A_{SV}$ has a value between about 3° and about 5°, and thus greater than the taper angles $A_B$, $A_V$ of the first bit assembly construction for reasons described below.

Furthermore, as with the first construction, when the valve 14 and bit 12 of the second construction are separate from or non-engaged with each other, the first value $v_{SO1}$ of the outside diameter $D_{SO}$ of each valve surface section 23 is greater than the first value $v_{SI1}$ of the inside diameter $D_{SI}$, of the corresponding bit surface section 19, and each outside diameter second value $v_{SO2}$ is greater than each corresponding inside diameter second value $v_{SI2}$. Thus, when the two components 12, 14 are uncoupled, each valve outer surface section 23 is spaced outwardly from the valve axis 14*a* by a greater radial distance than the corresponding bit inner surface section 19 is spaced from the bit axis 12*a*. Therefore, when the valve engagement portion 20 is inserted into the bore retainer portion 16, the valve 14 engages the bit 12 with an interference fit, such that the valve engagement portion 20 must be press-fit into the bore retainer section 16, which, due to the structure described above, generates the substantially uniform contact pressure P between each pair of mating surfaces 19, 23, and thus the frictional forces that maintain the valve 14 coupled with the bit 12.

Preferably, the bore retainer portion 16 has an interior end 16*a* located between the bit axial ends 12*a*, 12*b*, such that the bore flow portion 27 extends from the retainer end 16*a* to the bit outer end 12*a*, and the second circumferential edge 18*b* of the bore conical surface 18 is axially spaced from the interior end 16*a* (i.e., toward the bit inner end 12*b*). As such, the retainer portion 16 of both bit assembly constructions further has a generally cylindrical inner surface 26 and a radial shoulder surface 28, which are preferably connected by a radiused surface 31. The cylindrical inner surface 26 extends circumferentially about the bit axis 12*a* and axially between the retainer portion interior end 16*a* and the conical surface second edge 18*b*. The shoulder surface 28 extends generally radially between the cylindrical inner surface 26 and the bore flow portion 27. Further, the cylindrical inner surface 26 is preferably spaced radially outwardly with respect to the inner circumferential surface 27*a* of the bore flow portion 27, such that the shoulder surface 28 faces generally toward the bit inner end 12*b*.

Figure 5:
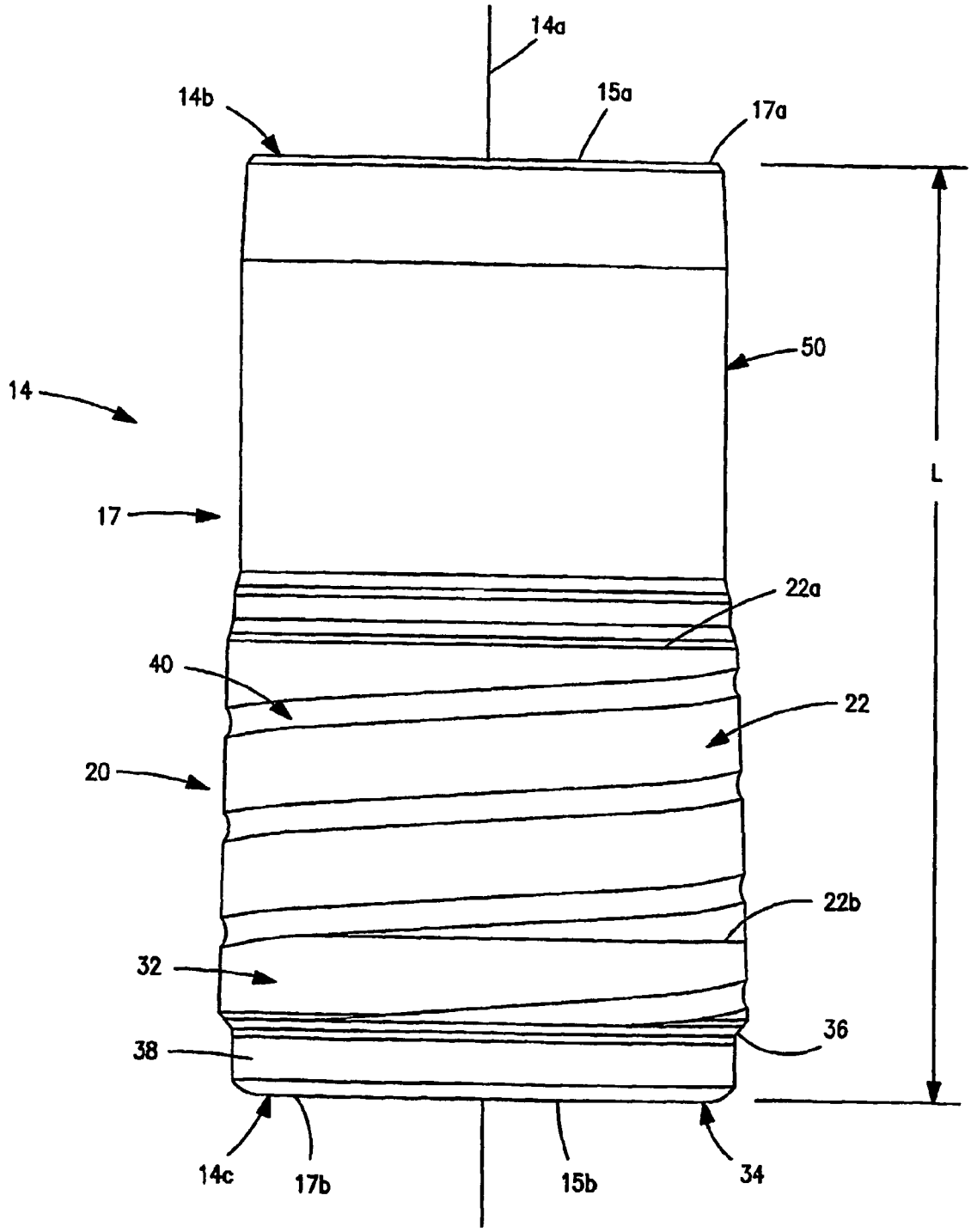
FIG. 5 is an elevational view of one preferred construction of the valve.

Additionally, the second edge 22*b* of the valve conical outer surface 22 of the first bit assembly construction or of the "lowermost" conical outer surface section 23A (i.e., the outer surface section 23 most proximal to valve second end 14*c*) of the second construction is preferably spaced axially from the valve second end 14*c*. As such, the valve engagement portion 20 of both bit assembly constructions further has a generally cylindrical outer surface 32. Specifically, the cylindrical outer surface 32 extends circumferentially about the valve axis 14*a* and generally axially between the valve second end 12*b* and the conical outer surface second edge 22*b*. Further, the valve 14 also has a generally radial end surface 34 located at the valve second end 14*c*, which extends about the valve second port 15*b* and is contactable with the bore shoulder surface 28, as discussed below. Referring particularly to FIG. 5, the valve engagement portion 20 may be formed so as to also include an offset section 38 spaced radially inwardly from the cylindrical outer surface 32, such that a generally radial shoulder 36 extends between the cylindrical outer surface 32 and the offset section 38, and axially between the cylindrical surface 32 and the end surface 34. Such an offset section 38 is provided to facilitate insertion of the valve engagement portion 20 into the bore inner end 13*a*.

With the structure described above, when the valve engagement portion 20 is disposed within the bit retainer portion 16, the valve end surface 34 is disposed generally against the bore shoulder surface 28 and the valve cylindrical outer surface 32 is disposed within the bit cylindrical inner surface 26. As such, contact between the valve shoulder surface 32 and the bit bore first shoulder surface 28 substantially prevents relative displacement between the valve 14 and the bit 12 in a first direction $d_1$, along the bit axis 12*a*. Further, contact between the valve conical outer surface 22 or surface sections 23 and the bit conical inner surface 18 or surface sections 19, respectively, prevents relative displacement between the valve 14 and the bit 12 in a second, opposing direction $d_2$ along the axis 12*a* during normal use of the drill 1. Preferably, the valve 14 remains coupled with the bit 12 during the productive life of the bit assembly 10, and the bit assembly 10 is discarded and replaced as a single unit. However, if it were desired to uncouple the valve 14 from the bit 12 (e.g., if newly connected valve 14 found defective/damaged), a sufficient force applied to the valve 14 in the second direction $d_2$ along the axis 12*a* will enable the valve 14 to deform radially inwardly to an extent sufficient to enable the valve conical outer surface 22/surface sections 23 to slide against the bit conical inner surface 18/surface sections 19 in the second direction $d_2$ until the valve 14 is disengaged from the bit 12, as discussed in further detail below.

Referring again to FIG. 5, the valve engagement portion 16 preferably further has at least one groove 40 extending generally radially into the valve 14 from the conical outer surface 22 and generally axially between opposing first and second axial ends 20*a*, 20*b* of the engagement portion 20. The one or mores grooves 40 (only one shown) are each fluidly connectable with the casing chamber 3 and with the bit bore 13 so as to permit fluid flow generally between the valve engagement portion 20 and the bit bore retainer portion 16 when the valve 14 is coupled with the bit 12. Such fluid flow convectively transfers thermal energy from the interface between the two conical surfaces 18, 22, which may be generated during normal use of the drill 1. Preferably, the groove(s) 40 further extend circumferentially about the valve axis 14*a* such that each groove 40 is generally helical, but may alternatively have any other appropriate shape and/or orientation with respect to the valve 14, such as for example, one or more longitudinal slots (not shown).

Referring again to FIGS. 1-7, the valve 14 further has a generally cylindrical "valving" or regulator portion 50 that extends axially between the engagement portion 20 and the valve first end 14*b*, such that the regulator portion 50 includes the valve first port 15*a* and a portion of the central passage 15. When the valve 14 is coupled with the bit 12 and the bit 12 is connected with the casing 2, the regulator portion 50 extends into the casing return chamber 3 from the bit inner end 12*b* and generally along the casing axis 2*a*. Further, the valve regulator portion 50 is disposable within the piston passage 4*a* when the piston 4*a* is located generally proximal to the bit inner end 12*b*. The valve 14 is configured to prevent fluid flow between the return chamber 3 and the bit bore 13 when the regulator portion 50 is disposed within the piston passage 4*a*. Alternatively, the valve 14 is configured to fluidly connect the casing chamber 3 with the bit bore 13 when the piston 4 is spaced a sufficient distance from the bit inner end 12*b* such that the regulator portion 50 is separate from or non-engaged with the piston 4.

Preferably, the bit 12 is substantially formed of a metallic material, and is most preferably machined from a low carbon steel forging. The valve 14 is preferably substantially formed of a polymeric material, such as being machined from extruded or molded DELRIN® (i.e., acetyl homopolymer) commercially available from the DuPont Corporation, or a lightweight metallic material, for example being cast from aluminum. However, it is within the scope of the present invention to form either the bit 12 or valve 14 of any appropriate material and/or by any appropriate process, such as for example, casting the bit 12 of an alloy steel, injection molding the valve 14 from another polymer, machining the valve 14 from a low carbon or alloy steel forging, forming the valve 14 of a composite of polymeric and metallic materials, etc.

With the structure above, the bit assembly 10 of the present invention is assembled generally in the following manner. With the bit 12 separate from the casing 2, the valve second end 14*c* is positioned at the bore inner end 13*a*, and then a force is applied in the first direction $d_1$ along the bit axis 12*a* to partially collapse or deform the valve 14 to thereby enable the valve 14 to move along the bit axis 12*a*. The cylindrical outer surface 32, and subsequently the conical outer surface 22, slides against the bit conical inner surface 18 or surface sections 19 until the valve cylindrical outer surface 32 becomes disposed within the bore cylindrical inner surface 26, and thereafter the valve radial end 34 contacts the bit radial shoulder 28. At this point, the valve engagement portion 20 is fully disposed within the bit retainer portion 16, and then valve regulator portion 50 extends away from the bit inner end 12*b*. As discussed above, the coupling of the valve 14 and bit 12 is thereafter maintained by the interference fit/frictional interaction between the bit and valve conical surfaces 18, 22 or surface sections 19, 23 and cylindrical surfaces 26, 32. The bit assembly 10 may then be installed in the casing 2 such that the bit upper end 12*b* is contactable by the piston strike end 4*b* and the valve regulator portion 50 is disposable within the piston passage 4*a* or/and within the return chamber 3.

Comparing the first and second constructions of the bit assembly 10, as discussed above, the bit 12 and the valve 14 of the first construction each have a single conical surface 18, 22 extending axially along generally the entire axial length $l_R$, $l_E$ of the retainer and engagement portions 16, 20. In the second bit assembly construction, the bit 12 and valve 14 each have a plurality of surface sections 19, 23 spaced apart axially along the retainer and engagement portions 16, 20 and each extending along an equal portion $l_{Rp}$, $l_{Ep}$ of the overall retainer or engagement portion lengths $l_R$, $l_E$ (see FIG. 6). By reducing the axial length of each engaged pair of surfaces 19, 23, the inner and outer surface sections 19, 23 of the second construction may each be formed with a greater or steeper taper angles $A_{SB}$, $A_{SV}$ (e.g., between about 3° and about 5°) as compared with the taper angles $A_{SB}$, $A_{SV}$ of the first bit assembly construction (e.g., between about 0.5° and about 3.0°).

With a steeper taper angle $A_{SB}$, $A_{SV}$ between the engaged bit and valve surfaces 19, 23, axial displacement of the valve 14 with respect to the bit 12, which may occur once the valve 14 begins to wear, is minimized. However, by increasing the taper angles $A_{SB}$, $A_{SV}$, the inside and outside diameters $D_{SI}$, $D_{SO}$ increase by a greater rate for a given distance along the bit and valve axes 12*a*, 14*a*. As such, the axial length portion $l_{Rp}$, $l_{Ep}$ of each surface section 19, 23 should not exceed a predetermined value in order to avoid having a maximum valve outside diameter $D_{SO}$ that is so much greater than the minimum bit inside diameter $D_{SI}$, that the valve material fails or becomes permanently deformed during insertion of the valve 14 within the bit 12. Therefore, to provide both an increased value of the taper angles $A_{SB}$, $A_{SV}$ (i.e., to reduce valve axial movement), prevent failure or permanent deformation of the valve 14, and provide a sufficient axial length of the zone of contact $Z_C$, the bit retainer portion 16 and the valve engagement portion 20 of the second bit assembly construction are each formed with a plurality of conical surface sections 19, 23.

The bit assembly 10 of the present invention has a number of advantages over previous designs of the valve 14 and bit 12. By having a zone of contact $Z_C$ (see FIGS. 4 and 7) between the valve 14 and bit 12 that extends both generally axially along and circumferentially about the two conical surfaces 18, 22, or pairs of surface sections 19, 23, and the cylindrical surfaces 26, 32, the contact pressure between the two components 12, 14 is dispersed over a relatively large area. As such, stress concentration in the valve 14 is substantially reduced, thus significantly reducing the failure rate of thereof. Further, with the bore conical surface 18 or surface sections 19 facing generally away from the bit inner end 12*b* and engaging the complementary valve surface 22 or surface sections 23, the bit 12 will tend to bias the valve 14 inwardly toward the bore shoulder surface 28, and away from the bit inner end 12*b*, even after the valve 14 begins to wear. As such, the geometry of the two contact surfaces 18, 22 or each pair of surface sections 19, 23 tends to maintain the valve 14 at a desired location along the bit axis 12*a*, and thus coupled with the bit 12.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined in the appended claims.

We claim:

1. A bit assembly for a percussive drill, the drill including a casing with an interior chamber, the bit assembly comprising:

a bit connectable with the casing and having a longitudinal bore and an axis extending centrally through the bore, the bore having a retainer portion with a retainer portion inner surface including at least one generally conical inner surface extending circumferentially about and facing generally toward the axis, the conical inner surface providing a majority of the retainer portion inner surface; and a generally cylindrical valve having a longitudinal passage, the passage having an inlet fluidly connectable with the casing chamber and an outlet fluidly connectable with the bit central bore, an axis extending centrally through the passage, and an engagement portion with an engagement portion outer surface including at least one generally conical outer surface extending circumferentially about and facing generally away from the valve axis, the conical outer surface providing a majority of the engagement portion outer surface, the valve engagement portion being disposeable within the bit bore retainer portion such that the valve conical outer surface is disposed within and against the bit conical inner surface so as to retain the valve coupled with the bit.

2. The bit assembly as recited in claim 1 wherein at least a substantial portion of the valve conical outer surface contacts the bit conical inner surface when the valve is engaged with the bit.

3. The bit assembly as recited in claim 1 wherein the valve conical outer surface is frictionally engageable with the bit conical inner surface so as to retain the valve coupled with the bit.

4. The bit assembly as recited in claim 1 wherein the valve conical outer surface is engageable with the bit conical inner surface such that a contact pressure between the two conical surfaces is substantially uniform at all points along the bit axis.

5. The bit assembly as recited in claim 1 wherein:

the bit has opposing inner and outer axial ends, the inner end being disposed within the casing and the outer end being disposed generally externally of the casing when the bit is connected with the casing, and the bore conical inner surface has axially spaced apart circumferential edges, the first edge being located proximal to the bit inner end and the second edge being located generally between the bit inner and outer ends, and an inside diameter that varies generally linearly between a first value at the surface first edge and a second value at the surface second edge, the second value being greater than the first value; and the valve conical outer surface has axially-spaced apart first and second circumferential edges, the valve surface first edge being disposed proximal to the bit surface first edge and the valve surface second edge being disposed proximal to the bit surface second edge when the valve is coupled with the bit, and an outside diameter that varies generally linearly between a first value at the valve surface first edge and a second value at the valve surface second edge, the outside diameter second value being greater than the outside diameter first value.

6. The bit assembly as recited in claim 5 wherein the valve outside diameter first value is greater than the bit inside diameter first value and the valve outside diameter second value is greater than the bit inside diameter second value such that the valve engages the bit with an interference fit.

7. The bit assembly as recited in claim 6 wherein contact between the valve end surface and the bit shoulder surface substantially prevents relative displacement between the valve and the bit in a first direction along the bit axis and contact between the valve conical outer surface and the bit conical inner surface generally prevents relative displacement between the valve and the bit in a second, opposing direction along the axis during use of the drill assembly.

8. The bit assembly as recited in claim 5 wherein:

the bit bore further has a flow portion extending between the retainer portion and the bit outer end and the retainer portion further includes a generally cylindrical inner surface, the cylindrical surface extending circumferentially about the bit axis and axially between the conical inner surface second edge and the flow portion, and a shoulder surface extending radially between the cylindrical inner surface and the bore flow portion and circumferentially about the bit axis, the shoulder surface facing generally toward the bit inner end; and the valve has opposing first end second axial ends, the valve first end being disposeable within the casing chamber and the valve second end being disposeable within the bit bore, and the valve engagement portion further has a generally cylindrical outer surface, the cylindrical outer surface extending circumferentially about the valve axis and generally axially between the conical outer surface second edge and the valve second end, and a radial end surface located at the valve second end, the valve end surface being disposed generally against the bit shoulder surface and the valve cylindrical outer surface being disposed within the bit cylindrical inner surface when the valve is coupled with the bit.

9. The bit assembly as recited in claim 8 wherein:

a length of the conical inner surface of the retainer portion of the bit is greater than a length of the cylindrical inner surface of the retainer portion of the bit; and a length of the conical outer surface of the engagement portion of the valve is greater than a length of the cylindrical outer surface of the engagement portion of the valve.

10. The bit assembly as recited in claim 1 wherein:

the bit has opposing inner and outer axial ends, the inner end being disposed within the casing and the outer end being disposed generally externally of the casing when the bit is connected with the casing, and the bore conical inner surface has axially spaced apart circumferential edges, the first edge being located proximal to the bit inner axial end and the second edge being located generally between the bit inner and outer axial ends, the conical inner surface having an inside diameter that tapers from the second edge to the first edge through a generally constant taper angle; and the valve conical outer surface has axially-spaced apart first and second circumferential edges, the valve surface first edge being disposed proximal to the bit surface first edge and the valve surface second edge being disposed proximal to the bit surface second edge when the valve is coupled with the bit, the conical outer surface having an outside diameter that tapers from the second edge to the first edge through a generally constant taper angle, the valve taper angle being substantially equal to the bit taper angle.

11. The bit assembly as recited in claim 10 wherein each one of the bit and valve taper angles has a value between about 0.5° and about 3.0°.

12. The bit assembly as recited in claim 10 wherein:

the inside diameter of the bit conical inner surface has a first value at the first surface edge and a second value at the second surface edge, the inside diameter first value being substantially greater than the second value; and the outside diameter of the valve conical outer surface has a first value at the first surface edge and a second value at the second surface edge, the outside diameter first value being substantially greater than the second value.

13. The bit assembly as recited in claim 1 wherein:

the bit has opposing inner and outer axial ends, the retainer portion extending generally from the bit inner end, the bit bore further has a flow portion extending between the retainer portion and the bit outer end, and the bore retainer portion further has a shoulder surface extending generally radially between the flow portion and the retainer portion and generally circumferentially about the bit axis, the shoulder facing generally toward the bit inner end, and a generally cylindrical inner surface extending axially between the shoulder and the bore retainer portion and circumferentially about the bit axis; and the valve further opposing first and second ends and the valve engagement portion further has a generally cylindrical outer surface, the cylindrical surface extending axially between the valve second end and the conical outer surface and circumferentially about the valve axis, and a generally radial end surface located at the valve second end, the valve end surface being disposeable generally against the bit shoulder surface and the valve cylindrical outer surface being disposed within the bit cylindrical inner surface when the valve is coupled with the bit.

14. The bit assembly as recited in claim 1 wherein the valve engagement portion has opposing axial ends and at least one groove extending generally radially into the valve from the conical outer surface and generally axially between the opposing first and second axial ends, the groove being fluidly connectable with the casing chamber and with the bit bore so as to permit fluid flow generally between the valve engagement portion and the bit bore retainer portion when the valve is coupled with the bit.

15. The bit assembly as recited in claim 14 wherein the groove further extends circumferentially about the axis such that the groove is generally helical.

16. The bit assembly as recited in claim 1 wherein:

the drill further has a central axis and a piston movably disposed within the casing chamber so as to displace generally along the drill axis, the piston having a longitudinal passage and a strike end;

the bit has an inner end contactable by the piston strike end; and the valve further has a regulator portion extending into the casing chamber from the bit inner end and generally along the drill axis when the valve is coupled with the bit, the regulator portion being disposeable within the piston passage and the valve being configured to prevent fluid flow between the casing chamber and the bit bore when the regulator portion is disposed within the piston passage.

17. The bit assembly as recited in claim 1 wherein the bit is substantially formed of metallic material and the valve is substantially formed of one of a polymeric material, a generally lightweight metallic material, and a composite of polymeric and metallic materials.

18. The bit assembly as recited in claim 1 wherein:

the conical inner surface extends along substantially the entire extent of the retainer portion; and the conical outer surface extends along substantially the entire extent of the engagement portion.

19. A bit assembly for a percussive drill, the drill including a casing with an interior chamber, the bit assembly comprising:

a bit connectable with the casing and having a longitudinal bore and an axis extending centrally through the bore, the bore having a retainer portion with at least one generally inner surface extending circumferentially about and facing generally toward the axis; and a generally cylindrical valve having a longitudinal passage, the passage having an inlet fluidly connectable with the casing chamber and an outlet fluidly connectable with the bit central bore an axis extending centrally through the passage, and an engagement portion with at least one generally conical outer surface extending circumferentially about and facing generally away from the valve axis the valve engagement portion being disposeable within the bit bore retainer portion such that the valve conical outer surface is disposed within and against the bit conical inner surface so as to retain the valve coupled with the bit;

wherein:

the bit retainer portion has a plurality generally conical inner surface sections extending circumferentially about and facing generally toward the axis, each one of the conical inner surface sections being spaced axially apart from each other inner surface section along the bit axis; and the valve engagement portion has a plurality of generally conical outer surface sections extending circumferentially about and facing generally toward the axis, each one of the conical outer surface sections being spaced axially apart from each other outer surface section along the valve axis and disposed against a separate one of the bit conical inner surface sections when the valve engagement portion is disposed within the bit bore retainer portion.

20. The bit assembly as recited in claim 19 wherein:

the bit retainer portion has three generally conical inner surface sections spaced along the bit axis; and the valve engagement portion has three generally conical outer surface portions spaced along the valve axis.

21. The bit assembly as recited in claim 19 wherein:

the bit retainer portion has a retainer portion inner surface, the plurality of generally conical inner surface sections providing a majority of the retainer portion inner surface; and the valve engagement portion has an engagement portion outer surface, the plurality of generally conical outer surface sections providing a majority of the engagement portion outer surface.

22. The bit assembly as recited in claim 19 wherein:

the bit has opposing inner and outer ends, the inner end being disposed within the casing and the outer end being disposed generally externally of the casing when the bit is connected with the casing, each of the plurality of generally conical inner surface sections having a first circumferential edge and a second circumferential edge spaced axially from the first circumferential edge toward the outer end, each of the plurality of generally conical inner surface sections having a first inner diameter at an associated first circumferential edge and a second inner diameter at an associated second circumferential edge, each second inner diameter being greater than each first inner diameter; and the valve has opposing first and second axial ends, the valve first end being disposeable within the casing chamber and the valve second end being disposeable within the bit bore, each of the plurality of generally conical outer surface sections having a first circumferential edge and a second circumferential edge spaced axially from the first circumferential edge toward the second axial end, each of the plurality of generally conical outer surface sections having a first outer diameter at an associated first circumferential edge and a second outer diameter at an associated second circumferential edge, each second outer diameter being greater than each first outer diameter.

23. The bit assembly as recited in claim 22 wherein:

the first inner diameter of each of the plurality of generally conical inner surface sections is substantially equal;

the second inner diameter of each of the plurality of generally conical inner surface sections is substantially equal;

the first outer diameter of each of the plurality of generally conical outer surface sections is substantially equal; and the second outer diameter of each of the plurality of generally conical outer surface sections is substantially equal.

24. The bit assembly as recited in claim 22 wherein:

the inner diameter of each of the plurality of generally conical inner surface sections tapers from the first circumferential edge to the second circumferential edge through a generally constant taper angle; the taper angle of the inner diameter of each of the plurality of generally conical inner surface sections being substantially equal; and the outer diameter of each of the plurality of generally conical outer surface sections tapers from the first circumferential edge to the second circumferential edge through a generally constant taper angle; the taper angle of the outer diameter of each of the plurality of generally conical outer surface sections being substantially equal.

25. A percussive drill assembly comprising:

a casing with an interior chamber and a longitudinal axis;

a piston movably disposed within the casing chamber so as to be displaceable generally along the axis, the piston having a central longitudinal axis;

a bit connected with the casing and having an inner end contactable by the piston strike end, a longitudinal bore, and an axis extending centrally through the bore and generally collinear with the casing axis, the bore having a retainer portion with a retainer portion inner surface including a generally conical inner surface extending circumferentially about and facing generally toward the axis, the conical inner surface providing a majority of the retainer portion inner surface; and a generally cylindrical valve having a longitudinal passage, the passage having an inlet fluidly connected with the casing chamber and an outlet fluidly connectable with the bit central bore, an axis extending centrally through the passage, and an engagement portion with an engagement portion outer surface including a generally conical outer surface extending circumferentially about and facing generally away from the valve axis, the conical outer surface providing a majority of the engagement portion outer surface, the valve engagement portion being disposeable within the bit bore retainer portion such that the valve conical outer surface is disposed within and against the bit conical inner surface to retain the valve coupled with the bit.

26. The drill assembly as recited in claim 25 wherein:

the conical inner surface extends along substantially the entire extent of the retainer portion; and the conical outer surface extends along substantially the entire extent of the engagement portion.

27. A bit assembly for a percussive drill, the drill including a casing with an interior chamber, the bit assembly comprising:

a bit connectable with the casing and having a longitudinal bore and an axis extending centrally through the bore, the bore having a retainer portion with at least one generally conical inner surface extending circumferentially about and facing generally toward the axis, the conical inner surface extending along a substantial portion of the bore; and a generally cylindrical valve having a longitudinal passage, the passage having an inlet fluidly connectable with the casing chamber and an outlet fluidly connectable with the bit central bore, an axis extending centrally through the passage, the valve having a length along the axis, and an engagement portion with at least one generally conical outer surface extending circumferentially about and facing generally away from the valve axis, the at least one conical outer surface extending along a substantial portion of the valve length, the valve engagement portion being disposeable within the bit bore retainer portion such that the valve conical outer surface is disposed at least partially within the bit conical inner surface to retain the valve coupled with the bit, at least a substantial portion of the valve conical outer surface being engageable with the bit conical inner surface so that a generally uniform contact pressure is generated between the conical inner surface and the conical outer surface.

28. The bit assembly as recited in claim 27 wherein:

the conical inner surface extends along substantially the entire extent of the retainer portion; and the conical outer surface extends along substantially the entire extent of the engagement portion.

29. An exhaust valve for a percussive drill, the drill including a casing with an interior chamber and a bit connectable with the casing, the bit having inner and outer ends, a longitudinal bore extending between the two ends and having an inner circumferential surface, the exhaust valve comprising:

a generally cylindrical body with first and second ends and a longitudinal passage extending between the two ends, the passage having an inlet fluidly at the first body end connectable with the casing chamber and an outlet at the second body end fluidly connectable with the bit bore, the valve body including a generally cylindrical regulator portion disposeable within the casing chamber and a generally conical engagement portion spaced axially from the regulator portion and being at least partially disposeable within the bit bore, the engagement portion having at least one generally conical outer surface frictionally engageable with the bit bore inner surface to retain the valve coupled with the bit, the conical outer surface having a first circumferential edge located generally proximal to the regulator portion, a second circumferential edge located generally proximal to the body second end, and an outside diameter that varies generally linearly between a first value at the surface first circumferential edge and a second value at the surface second circumferential edge, the diameter second value being greater than the diameter first value.

30. The exhaust valve as recited in claim 29 wherein the conical outer surface extends along substantially the entire extent of the engagement portion.

* * * * *